US010905207B2

(12) United States Patent
Krainz

(10) Patent No.: US 10,905,207 B2
(45) Date of Patent: Feb. 2, 2021

(54) JEWELRY RING HAVING AN AUTOMATIC SIZE ADJUSTING DEVICE

(71) Applicant: KRAINZ CREATIONS, INC., New York, NY (US)

(72) Inventor: Roland Krainz, Brookfield, CT (US)

( * ) Notice: Subject to any disclaimer, the term of this patent is extended or adjusted under 35 U.S.C. 154(b) by 153 days.

(21) Appl. No.: 15/897,259

(22) Filed: Feb. 15, 2018

(65) Prior Publication Data

US 2019/0246752 A1 Aug. 15, 2019

(51) Int. Cl.
*A44C 9/02* (2006.01)

(52) U.S. Cl.
CPC ..... *A44C 9/02* (2013.01)

(58) Field of Classification Search
CPC ..... A44C 9/00; A44C 9/02; A44C 9/0015
USPC ..... 63/15, 15.5, 15.6, 15.65
See application file for complete search history.

(56) References Cited

U.S. PATENT DOCUMENTS 474,638 A * 5/1892 Huestis ..... A44C 9/00 63/15
1,146,543 A * 7/1915 Abel ..... A44C 9/00 63/15
1,219,172 A * 3/1917 Segman ..... A44C 9/02 63/15.6
1,325,840 A * 12/1919 Feagans ..... A44C 9/00 63/15
2,615,314 A 10/1952 Axel
2,778,207 A * 1/1957 Thaler ..... A44C 9/02 63/15.6
3,022,648 A * 2/1962 Thaler ..... A44C 9/0084 63/15
3,071,940 A * 1/1963 Schneider ..... A44C 9/00 63/15
3,606,767 A * 9/1971 Auchere ..... A44C 9/02 63/15.5
5,943,882 A * 8/1999 Erb ..... A44C 9/02 63/15.5

(Continued)

FOREIGN PATENT DOCUMENTS

DE 1140768 B * 12/1962 ..... A44C 9/02

OTHER PUBLICATIONS

WO, International Search Report; International Application No. PCT/US2019/018105, dated Apr. 15, 2019 (2 Pages).

(Continued)

*Primary Examiner* — Emily M Morgan
(74) *Attorney, Agent, or Firm* — FisherBroyles, LLP; Susan M. Oiler

(57) ABSTRACT

A jewelry ring having an outer ring fixedly spaced radially apart from an inner ring by a connecting member where the outer ring defines a plurality of open mountings and the inner ring defines a first plurality of openings, which are aligned with one another. At least two of the plurality of openings in the inner ring are interconnected by a slot to collectively define a receptacle in which a size adjusting device is seated and is connected thereto by a slot and pin mechanism enabling the size adjusting device to translate radially between a smallest interior diameter position and a largest interior diameter position. The size adjusting device has an arcuate insert defining a second plurality of openings aligned one each with one of the plurality of open mountings of the outer ring and has a biasing member seated between the arcuate insert and the outer ring.

22 Claims, 10 Drawing Sheets

(56) References Cited

U.S. PATENT DOCUMENTS

| | | | | |
|---|---|---|---|---|
| 6,003,334 | A * | 12/1999 | Miller | A44C 9/02 63/15.5 |
| 6,748,764 | B1 | 6/2004 | Roemer | |
| 7,430,879 | B2 * | 10/2008 | Czajka | A44C 9/02 63/15.5 |
| 7,845,191 | B2 * | 12/2010 | Czajka | A44C 9/0015 63/15.6 |
| 8,573,004 | B2 | 11/2013 | Demeglio | |
| 10,390,591 | B2 * | 8/2019 | Bassan | A44C 17/02 |
| 2005/0199007 | A1 * | 9/2005 | LaCroix | A44C 9/00 63/28 |
| 2007/0137249 | A1 * | 6/2007 | Czajka | A44C 9/02 63/15.6 |
| 2009/0056373 | A1 * | 3/2009 | Czajka | A44C 9/0015 63/3 |
| 2009/0071192 | A1 * | 3/2009 | Bauman | A44C 9/00 63/15 |
| 2012/0180523 | A1 * | 7/2012 | Meyerhoff | A44C 9/02 63/15.6 |
| 2015/0296932 | A1 | 10/2015 | Escobar | |
| 2018/0352916 | A1 * | 12/2018 | Zuluaga Escobar | A44C 9/02 |
| 2019/0125042 | A1 * | 5/2019 | Bassan | A44C 17/02 |

OTHER PUBLICATIONS

WO, International Search Report Written Opinion; International Application No. PCT/US2019/018105, dated Apr. 15, 2019 (5 Pages).

Webpage featuring "Finger Mate Hinged, Expandable, ring shanks" http://fingermate.com/ accessed on Jul. 26, 2017.

* cited by examiner

SMALLEST INTERIOR DIAMETER POSITION

LARGEST INTERIOR DIAMETER POSITION

JEWELRY RING HAVING AN AUTOMATIC SIZE ADJUSTING DEVICE

TECHNICAL FIELD

The present application relates generally to jewelry and, more particularly, to a jewelry ring having a size adjusting device for automatically adjusting the ring size.

BACKGROUND

A common problem with jewelry, particularly rings, is that the size of the human hand can fluctuate from a variety of factors ranging from extremely cold weather or warm weather to weight gain. Thus, a ring that has a diameter of 15 mm may fit comfortably today but is uncomfortably tight or loose tomorrow. This is particularly undesirable for rings as certain rings, such as engagement or wedding rings, are worn every day.

While a person can have a ring resized by a jeweler, such a solution is not practical. First, it is inconvenient to require a person to schedule time to resize jewelry. Second, there is a risk that, upon resizing, imperfections are introduced into the metal comprising the jewelry. Therefore, a system is sought where a person can wear a ring comfortably despite common changes in finger size.

Many attempts at ring sizing systems have been tried, but it is especially challenging when the ring contains a plurality of gem stones or the like, especially if the stones encompass the circumference of the entire endless band. Example systems are found in U.S. Pat. No. 8,573,004 and U.S. 2015/0296932. Both systems fail to allow adequate light to reach the stones through multiple surfaces of the endless band because they employ continuous, solid surface, movable members in the interior of the ring.

Accordingly, an adjustable ring sizing system is desired to provide a person the ability to comfortably wear a ring despite internal physiological changes or external temperature changes causing a person's finger to increase or decrease in diameter, and to provide ample light to the stone for the best sparkle and brilliance of the stone. The ring sizing system disclosed herein meets these needs and solves the problems of the prior art ring sizing systems.

SUMMARY

In one aspect, jewelry rings are disclosed that have an outer ring fixedly spaced radially apart from an inner ring by a connecting member. The outer ring defines a plurality of open mountings to hold a gem or gemstone and the inner ring defines a first plurality of openings, one each aligned with one of the plurality of open mountings of the outer ring. Within the inner ring at least two of the plurality of openings are interconnected by a slot to define a receptacle in each of which is seated a size adjusting device. Each size adjusting device is connected to its receptacle by a slot and pin mechanism enabling the size adjusting device to translate radially in and out between a smallest interior diameter position and a largest interior diameter position. The size adjusting device has an arcuate insert that defines a second plurality of openings aligned one each with one of the plurality of open mountings of the outer ring and has a biasing member seated between the radially outer facing surface thereof and the outer ring.

In all embodiments, the radially outward facing surface of the arcuate insert defines a receptacle for the biasing member, and the biasing member can be a coil spring or an elastomeric member. In all embodiments, for the pin and slot mechanism, the pin extends from the inner ring and the slot is in the arcuate insert or, oppositely, the pin extends from the arcuate insert and the slot is in the inner ring.

In one embodiment, the plurality of open mountings of the outer ring connect to touch one to another about the central axis to define the entire circumference of the outer ring.

In one embodiment, the jewelry ring has a plurality of arcuate inserts, and each of the plurality of arcuate inserts has two oval-shaped or circular-shaped rings connected by a linking member. In another embodiment, the jewelry ring has a plurality of arcuate inserts, and each has three oval-shaped or circular-shaped rings having immediately neighboring rings connected by a linking member. In either of these embodiments, each arcuate insert of the plurality of arcuate inserts is spaced equidistant apart from an immediately neighboring arcuate insert about the inner circumference of the inner ring. In one variation, the plurality of arcuate inserts comprises two arcuate inserts, one centered at a position 120° clockwise from a primary mount and a second centered at a position 240° clockwise from a primary mount.

In another aspect, jewelry rings are disclosed that have an outer ring fixedly spaced radially apart from an inner ring by a connecting member, where the outer ring defines an open mounting to hold a gem or gemstone and the inner ring defining a first plurality of openings. One of the first plurality of opening in the inner ring is aligned with the open mountings of the outer ring, and at least two of the plurality of openings in the inner ring are interconnected by a slot to collectively defining a receptacle in which is seated a size adjusting device. The size adjusting device is connected to the receptacle by a slot and pin mechanism enabling the size adjusting device to translate radially in and out between a smallest interior diameter position and a largest interior diameter position. The size adjusting device has an arcuate insert that defines a second plurality of openings aligned one each with the at least two others of the plurality of opening, and has a biasing member seated between its radially outer facing surface and the outer ring.

In all embodiments of this second aspect of the jewelry rings, the radially outward facing surface of the arcuate insert defines a receptacle for the biasing member, and the biasing member can be a coil spring or an elastomeric member. In all embodiments, for the pin and slot mechanism, the pin extends from the inner ring and the slot is in the arcuate insert or, oppositely, the pin extends from the arcuate insert and the slot is in the inner ring.

In one embodiment of the second aspect of the jewelry rings, the jewelry ring has a plurality of arcuate inserts, and each of the plurality of arcuate inserts has two oval-shaped or circular-shaped rings connected by a linking member. In another embodiment, the jewelry ring has a plurality of arcuate inserts, and each has three oval-shaped or circular-shaped rings having immediately neighboring rings connected by a linking member. In either of these embodiments, each arcuate insert of the plurality of arcuate inserts is spaced equidistant apart from an immediately neighboring arcuate insert about the inner circumference of the inner ring. In one variation, the plurality of arcuate inserts comprises two arcuate inserts, one centered at a position 120° clockwise from a primary mount and a second centered at a position 240° clockwise from a primary mount.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present system.

DETAILED DESCRIPTION

Figure 1:
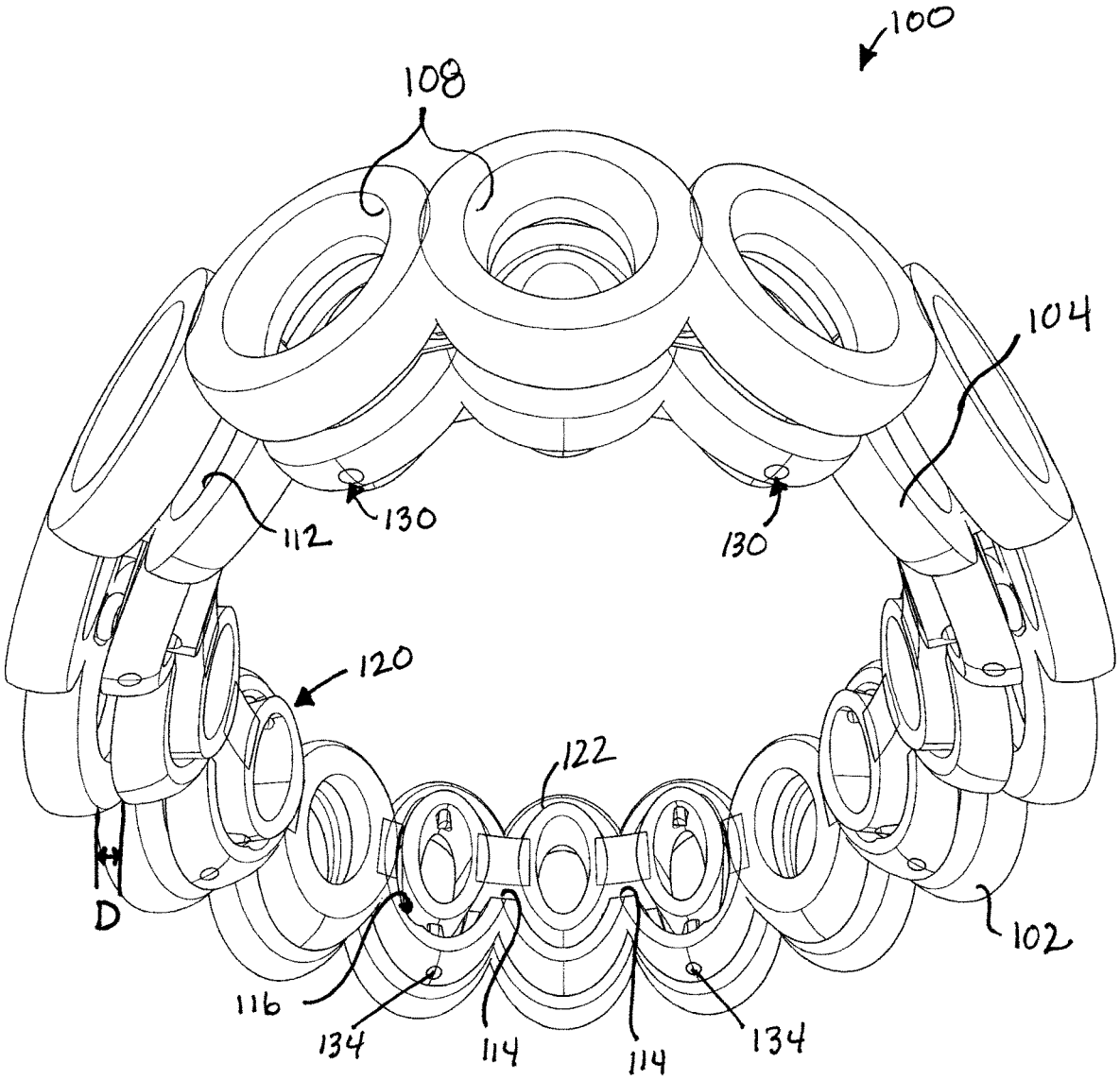
FIG. 1 is a top, perspective view of a jewelry ring (without gems or gemstones) having a first embodiment of a size adjusting device in its smallest interior diameter position (smallest ring size).

The following detailed description will illustrate the general principles of the invention, examples of which are additionally illustrated in the accompanying drawings. In the drawings, like reference numbers indicate identical or functionally similar elements.

Figure 2:
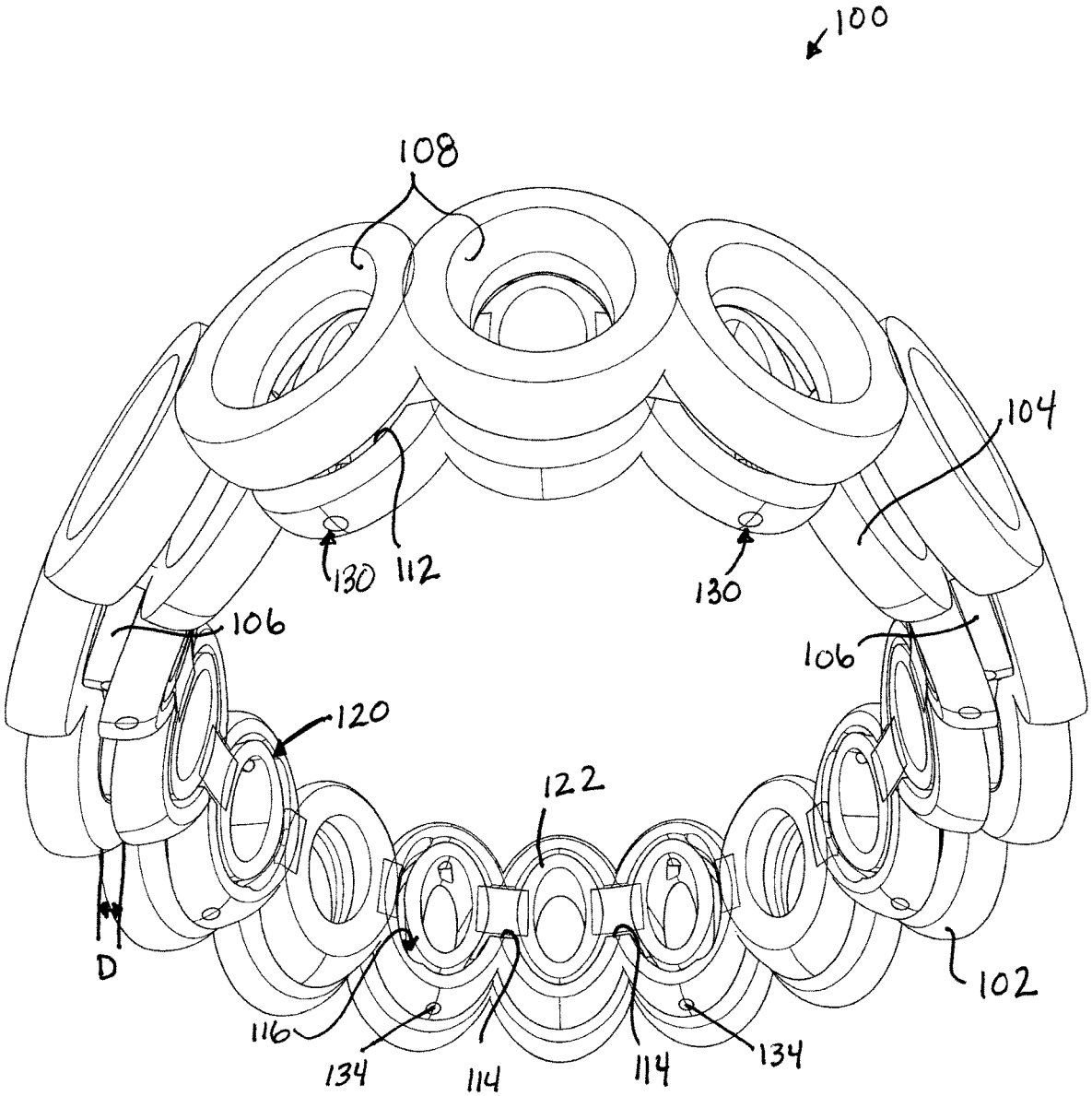
FIG. 2 is a top, perspective view of the jewelry ring of FIG. 1 with the size adjusting device in its largest interior diameter position (largest ring size).
Figure 3:
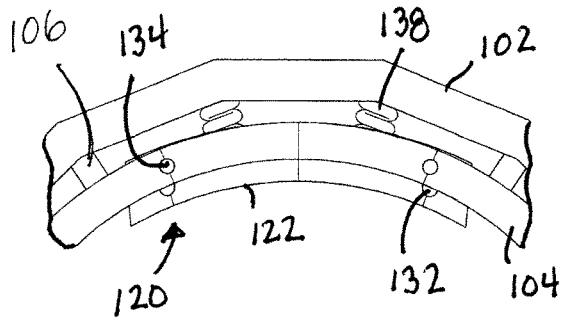
FIG. 3 is a partial side, plan view of the jewelry ring of FIG. 1.
Figure 4:
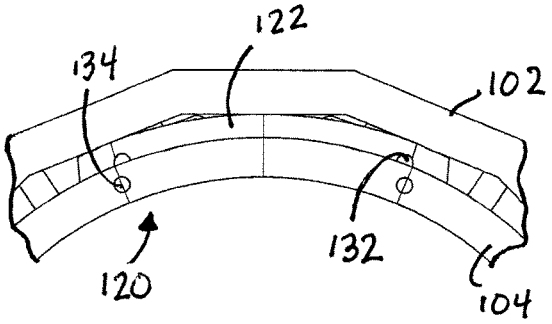
FIG. 4 is a partial side, plan view of the jewelry ring of FIG. 2.

Referring now to FIGS. 1-2, a jewelry ring, generally referenced by reference number 100, is shown without gems or gemstones or the like seated in the outer ring 102. The jewelry ring 100 includes a ring sizing system 120 that translates radially inward and outward using a slot and pin mechanism 130, which enables the jewelry ring to automatically adjust the inner diameter thereof. The inner diameter of the jewelry ring 100 may be adjustable by the size adjusting device 120 to any diameter between at least two jewelry ring sizes. For example, in one embodiment, the ring is a size 6 in the smallest interior diameter position as illustrated in FIGS. 1 and 3 and is a size 8 in the largest interior diameter position illustrated in FIGS. 2 and 4. In another embodiment, the ring is a size 5 in the smallest interior diameter position and is a size 7 in the largest interior diameter position. A second embodiment of a jewelry ring with diamonds 110 is presented in FIG. 14, generally designated by reference 200, demonstrating the same invention, but with shorter length size adjusting mechanisms 220.

Figure 8:
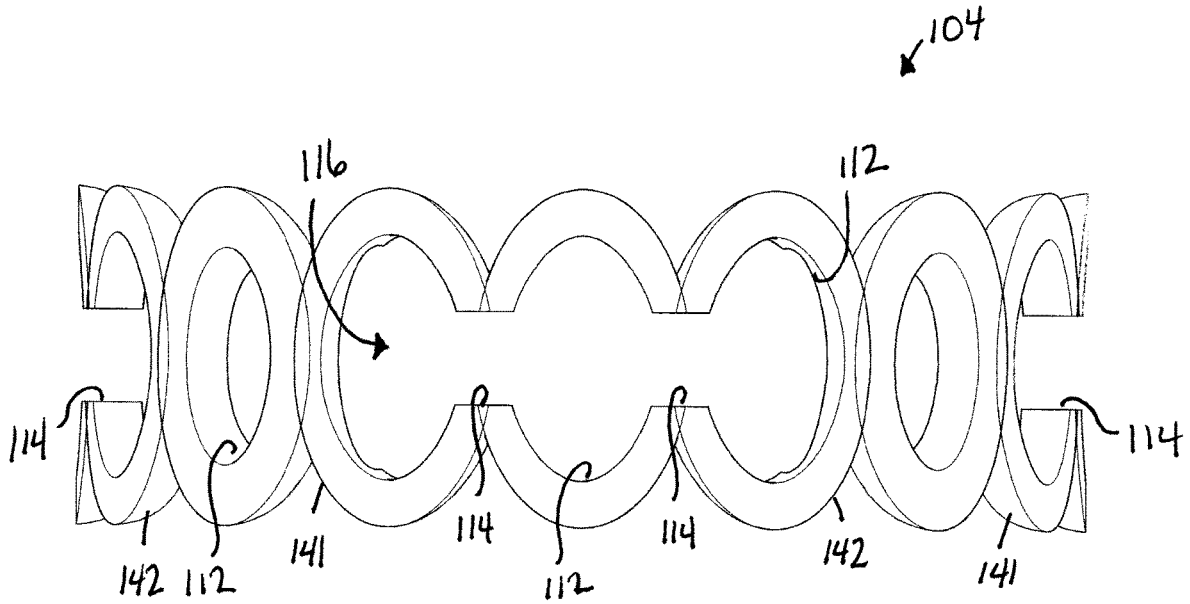
FIG. 8 is a top perspective view of the inner ring of the jewelry ring of FIGS. 1 and 2.
Figure 9:
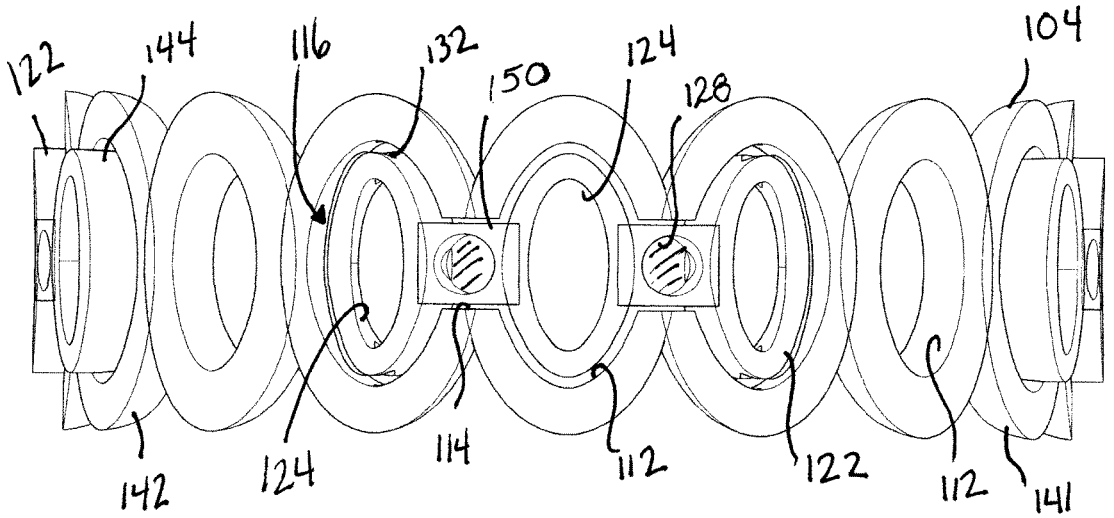
FIG. 9 is a top perspective view of the inner ring of FIG. 8 with the arcuate insert of FIG. 6 seated therein.
Figure 13:
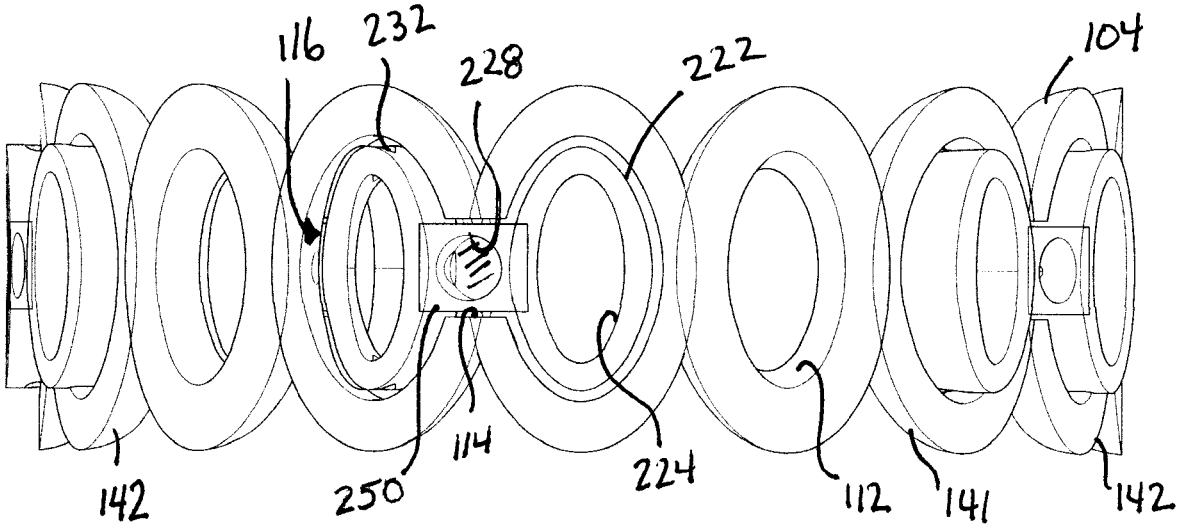
FIG. 13 is a top perspective view of the inner ring with the arcuate insert of FIG. 11 seated therein

The jewelry ring 100 has an outer ring 102 fixedly spaced radially inward and apart a distance D from an inner ring 104 by a connecting member 106, best seen in FIG. 2. D may be 0.1 mm to 3 mm, or more preferably 0.25 mm to 2 mm. The outer ring 102 defines a plurality of open mountings 108 to each hold a gem, gemstone or the like and the inner ring 104 defines a first plurality of openings 112, one each aligned with one of the plurality of open mountings 108 of the outer ring 102. As shown in FIG. 1, each of the outer and inner rings 102, 104 are endless rings, and in this particular embodiment, the plurality of open mountings 108 of the outer ring 102 connect to touch one to another about the central axis to define the entire circumference of the outer ring. Likewise, the first plurality of openings 112 of the inner ring 104 connect to touch one to another about the central axis to define the entire circumference of the inner ring. As most easily viewed from FIGS. 8 and 13, at least two of the plurality of openings 112 in the inner ring 104 are interconnected by a slot 114 thereby collectively defining a receptacle 116 to receive an arcuate insert 122, 222 of the size adjusting device 120, 220.

With reference to all the figures, the size adjusting device 120, 220 is seated in the receptacle 116 and is connected to the receptacle 116 by a slot and pin mechanism 130 enabling the size adjusting device 120, 220 to translate radially in and out between the smallest interior diameter position and the largest interior diameter position. As illustrated, the pin 134 of the pin and slot mechanism 130 extends from the inner ring 104 into a slot 132, 232 in the arcuate insert 122, 222. Conversely, however, the pin may extend from the arcuate insert 122, 222 and the slot may be in the inner ring 104. In the illustrated examples, each size adjusting device 120, 222 has four pin and slot combinations, two each in opposing axially facing sides of the first and second ends 141, 142 of the receptacle 116 (FIG. 6) and first and second ends 143, 144 or 243, 244 of the arcuate insert 122, 222 (FIGS. 5 and 11), respectively. In all embodiments, the size adjusting device may have two pin and slot combinations at opposing longitudinal ends of the arcuate insert and of the receptacle, rather than four such combinations.

Figure 5:
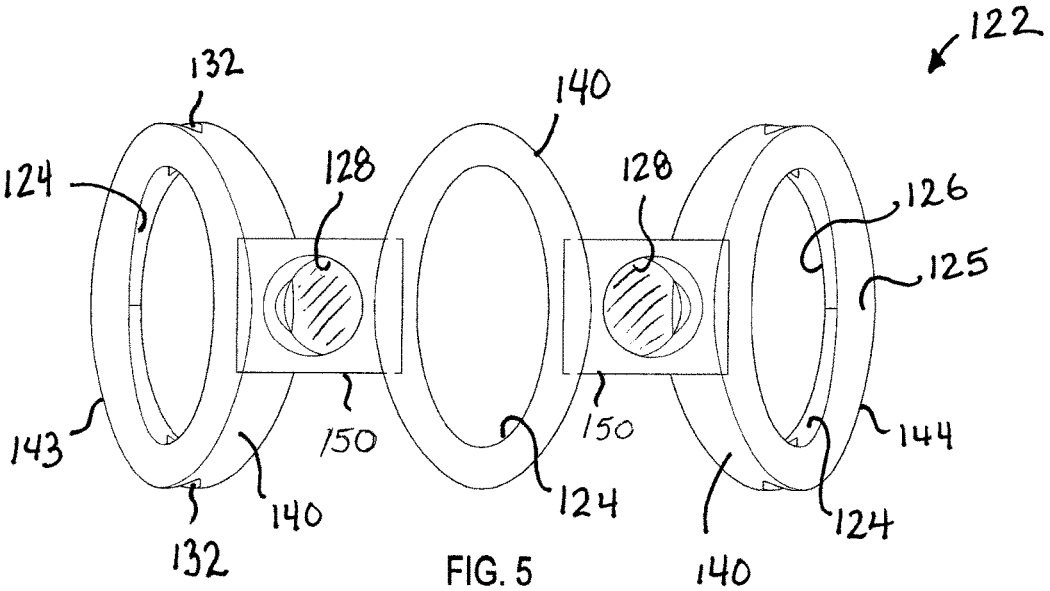
FIG. 5 is a top perspective view of the arcuate insert in FIGS. 1 and 2.
Figure 6:
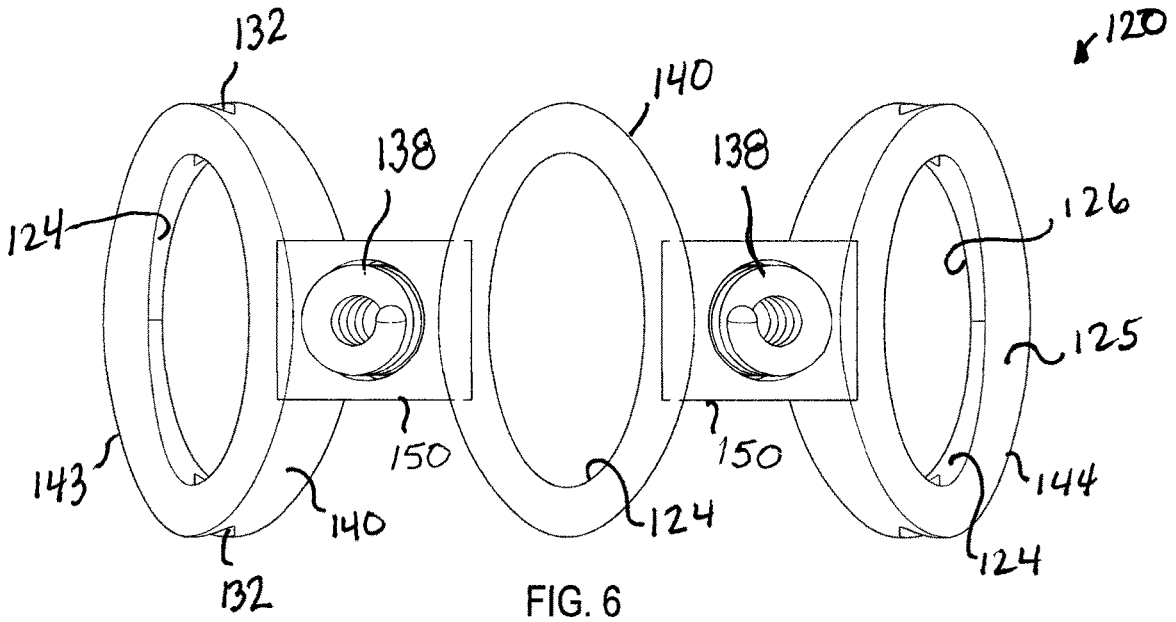
FIG. 6 is a top perspective view of the arcuate insert of FIG. 5 with a spring seated in each spring receptacle.
Figure 7:
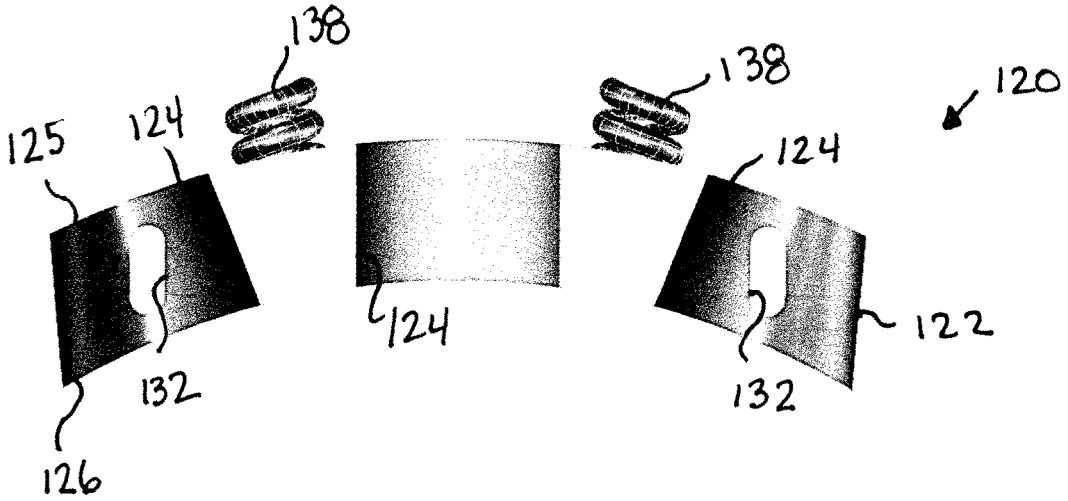
FIG. 7 is a longitudinal cross-sectional view of FIG. 6.
Figure 11:
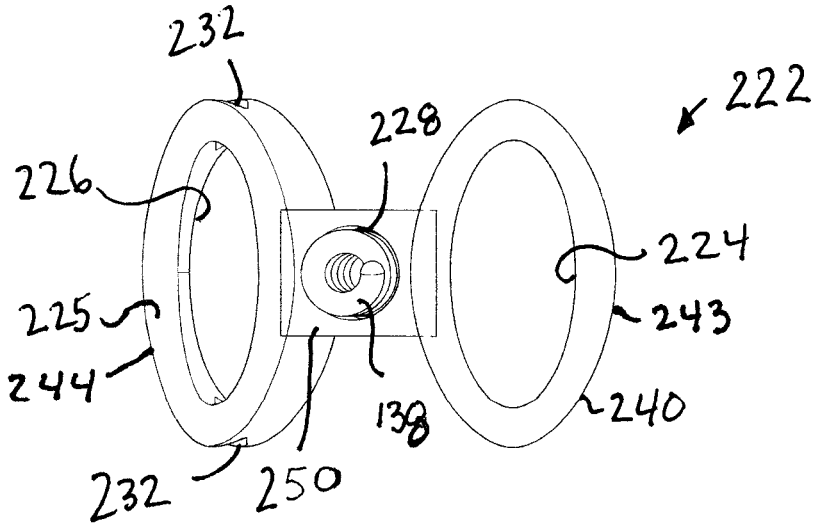
FIG. 11 is a top perspective view of a second embodiment of a size adjusting device.
Figure 12:
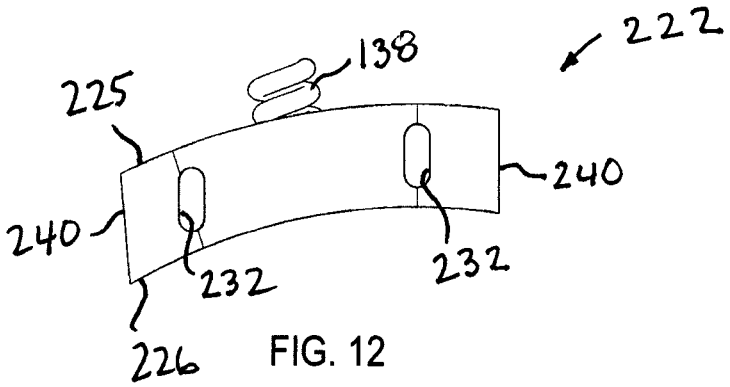
FIG. 12 is a side, plan view of the size adjusting device of FIG. 11.

With reference to FIGS. 5-7 and FIGS. 11-12, the ring sizing system 120, 220 has an arcuate insert 122, 222 that defines a second plurality of openings 124, 224 aligned one each with one of the first plurality of openings 112 in the inner ring, and it may also be aligned with one of the plurality of open mountings 108 of the outer ring 102. Each arcuate insert 122, 222 has a radially outer facing surface 125 and a radially inner facing surface 126 spaced apart by opposing sides extending axially. Referring specifically to FIGS. 5-7, each arcuate insert 122 has a plurality of biasing member 138 seated between the radially outer facing surface 125 thereof and a radially inner surface of the outer ring 102. Referring specifically to FIGS. 11-12, each arcuate insert 222 has a biasing member 138 seated between its radially outer facing surface 125 and a radially inner surface of the outer ring 102. The biasing member 138 is shown in the figures as a coil spring, but it may be an elastomeric member or any other type of spring.

As illustrated in the figures, typically a plurality of arcuate inserts 122, 222 are present to define the size adjusting device 120, 220, but one arcuate insert is possible if of an appropriate length and position. Referring to FIGS. 5, 6, and 11, each arcuate insert 122, 222 comprises a plurality of segments 140, 240 having a preselected exterior shape that each define one of the second plurality of openings 124, 224. Immediately neighboring segments 140, 240 are connected to one another by a linking member 150, 250. The preselected exterior shape may be oval, circular, or any polygonal shape and the openings 124, 224 likewise may be oval, circular, or any polygonal shape. The shape should be selected based on the shape of the gem, gemstone or the like selected for inclusion in the jewelry ring. In the embodiment of FIG. 11, two oval-shaped segments 240 are linked together by a linking member 250 and each of the two oval-shaped segments define one of the plurality of openings 224. In the embodiment of FIGS. 5 and 6, three oval-shaped segments 140 are present with immediately neighboring segments linked together by a linking member 150, and each of the three oval-shaped segments define one of the plurality of openings 124. In other embodiments, arcuate inserts may have four, five, six, seven, or eight segments linked in a similar manner.

As most clearly seen in FIGS. 5-6 and 11, the linking members 150, 250 include a seat for the biasing member 138, for example, a recess defining a receptacle 128, 228 in which one end of the biasing member 138 is seated. If the biasing member 138 is a coil spring, the receptacle 128, 228 may include a tang abutment or hole to receive a first end of the coil spring.

Figure 10:
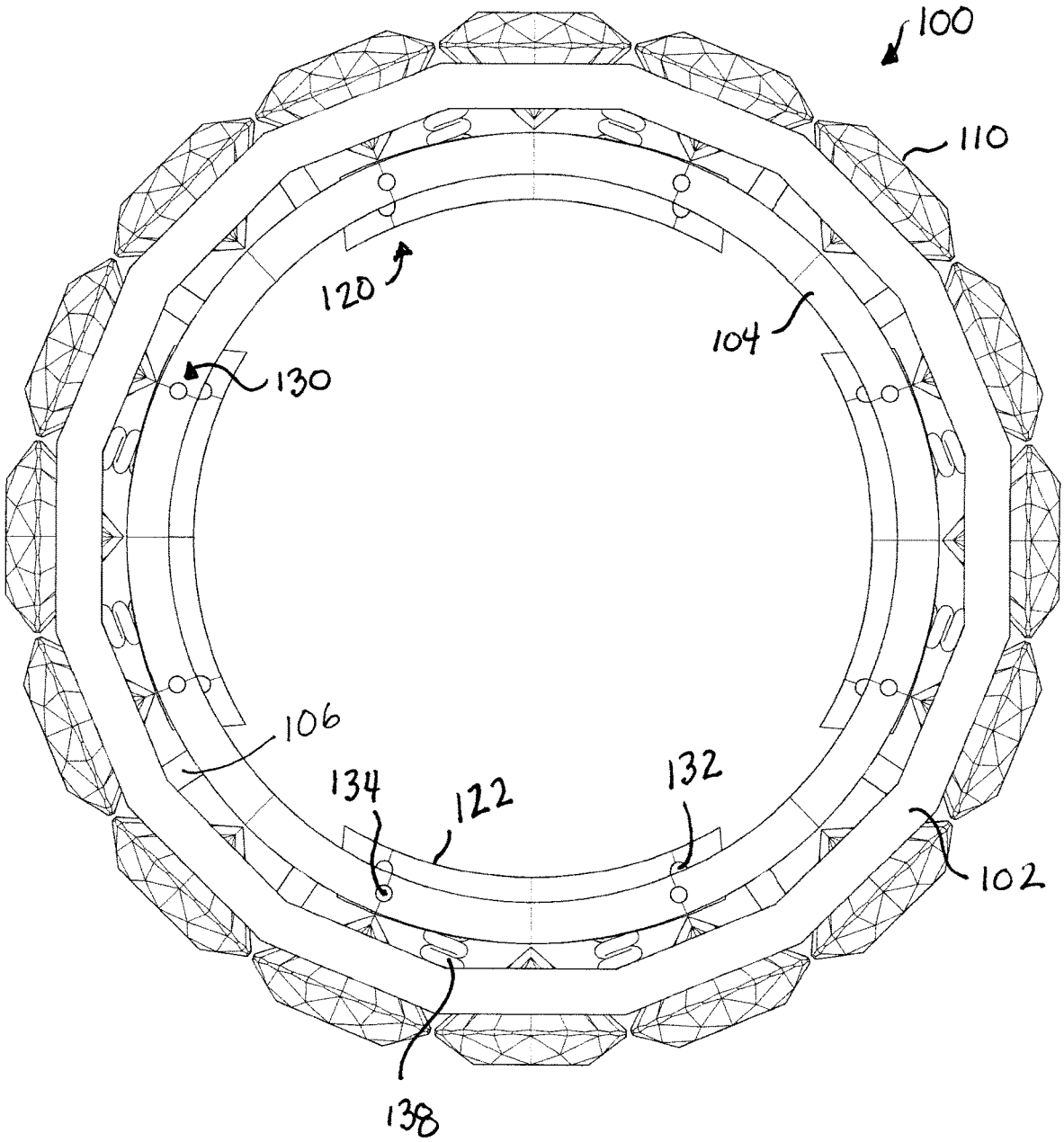
FIG. 10 is a side, plan view of the jewelry ring of FIG. 1 with diamonds set therein.
Figure 14:
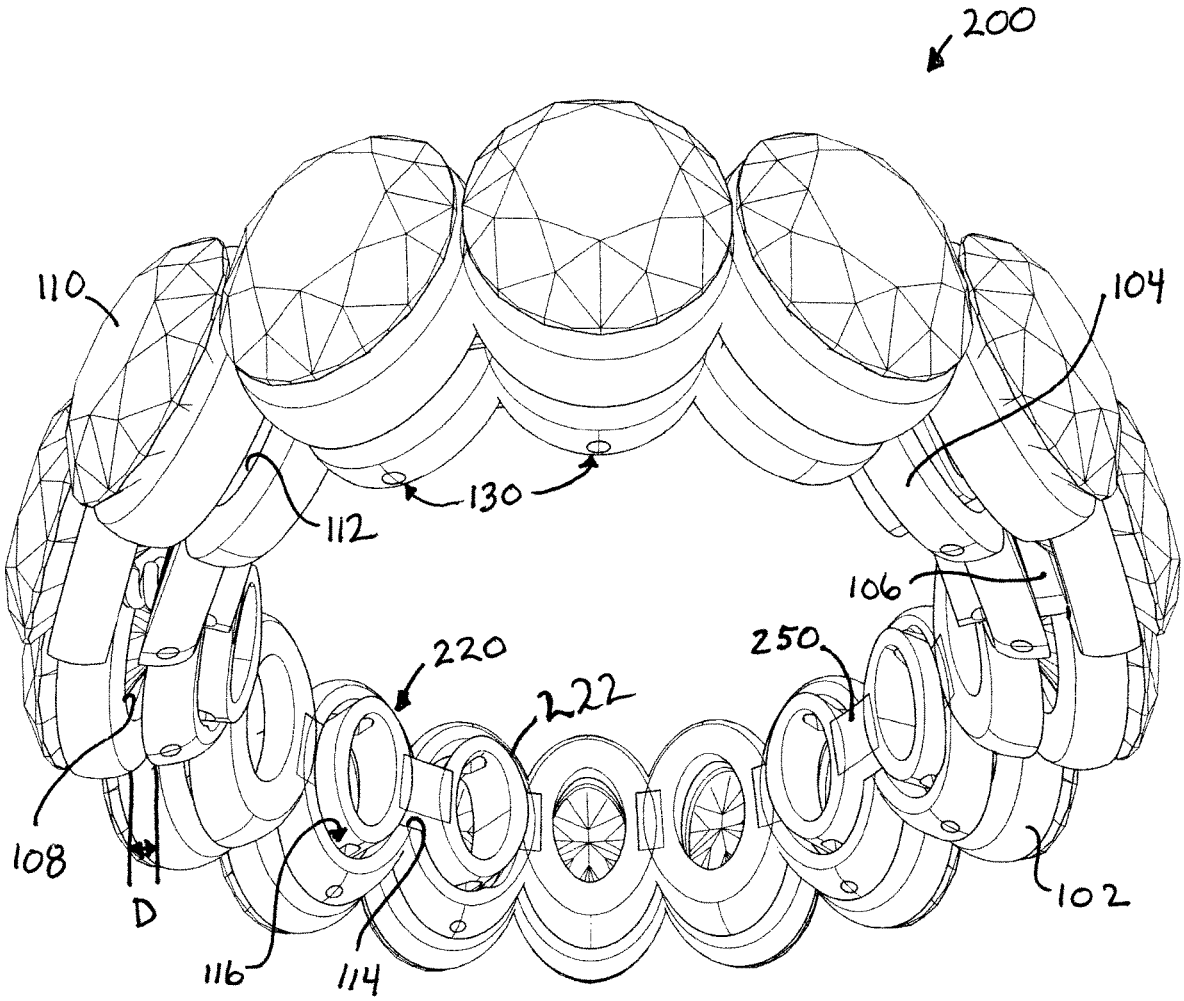
FIG. 14 is a top perspective view of second embodiment of a jewelry ring having the size adjusting device of FIG. 11 in the smallest interior diameter position.
Figure 15:
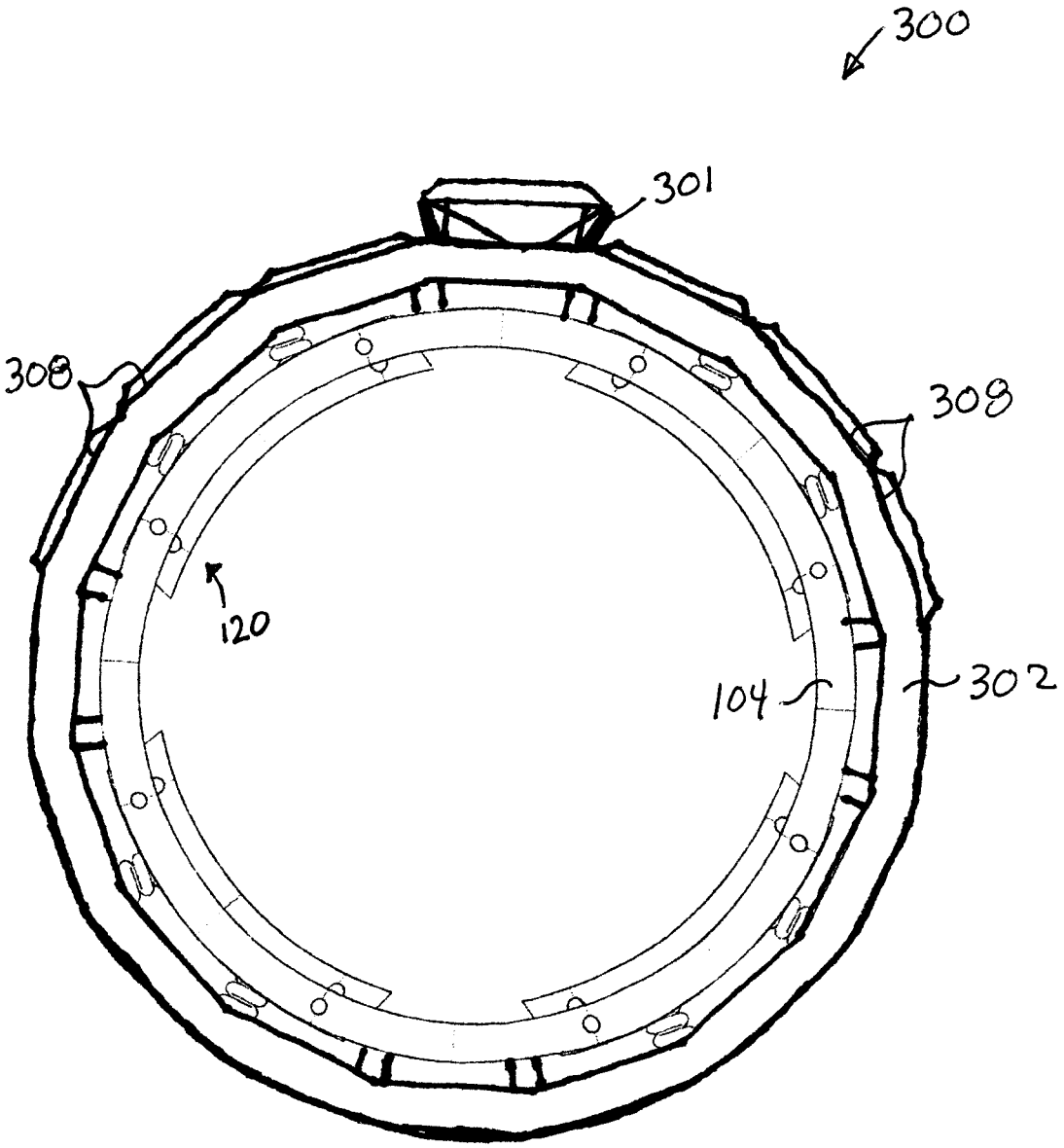
FIG. 15 is a side, plan view of a third embodiment of a jewelry ring having one of the size adjusting devices.

Referring now to FIGS. 10, 14, and 15, the plurality of arcuate 122, 222 inserts are spaced equidistant apart from each immediately neighboring arcuate insert about the inner circumference of the inner ring. In FIGS. 10 and 15, there are four arcuate inserts 120. In FIG. 14, there are five arcuate inserts 222.

Turning now to FIG. 15, a third embodiment of a jewelry ring, generally designed by reference number 300, is illustrated that has a primary mount 301 as part of the outer ring 302 and a plurality of open mountings 308 to the left and to the right of the primary mount 301. The remainder of the outer ring 302 extending between the left set of plurality of openings and the right set of the plurality of open mountings 308 is shown in FIG. 15 as a continuous radially facing outer surface defining a portion of the band of the ring. However, the whole outer ring may define a plurality of open mountings as shown in FIG. 1, but with the addition of the primary mount 301. The other features of jewelry ring 300 are as discussed above for any of the embodiments of the size adjusting device, even though the size adjusting device is illustrated as being of the style 120 from FIGS. 1-10.

Figure 16:
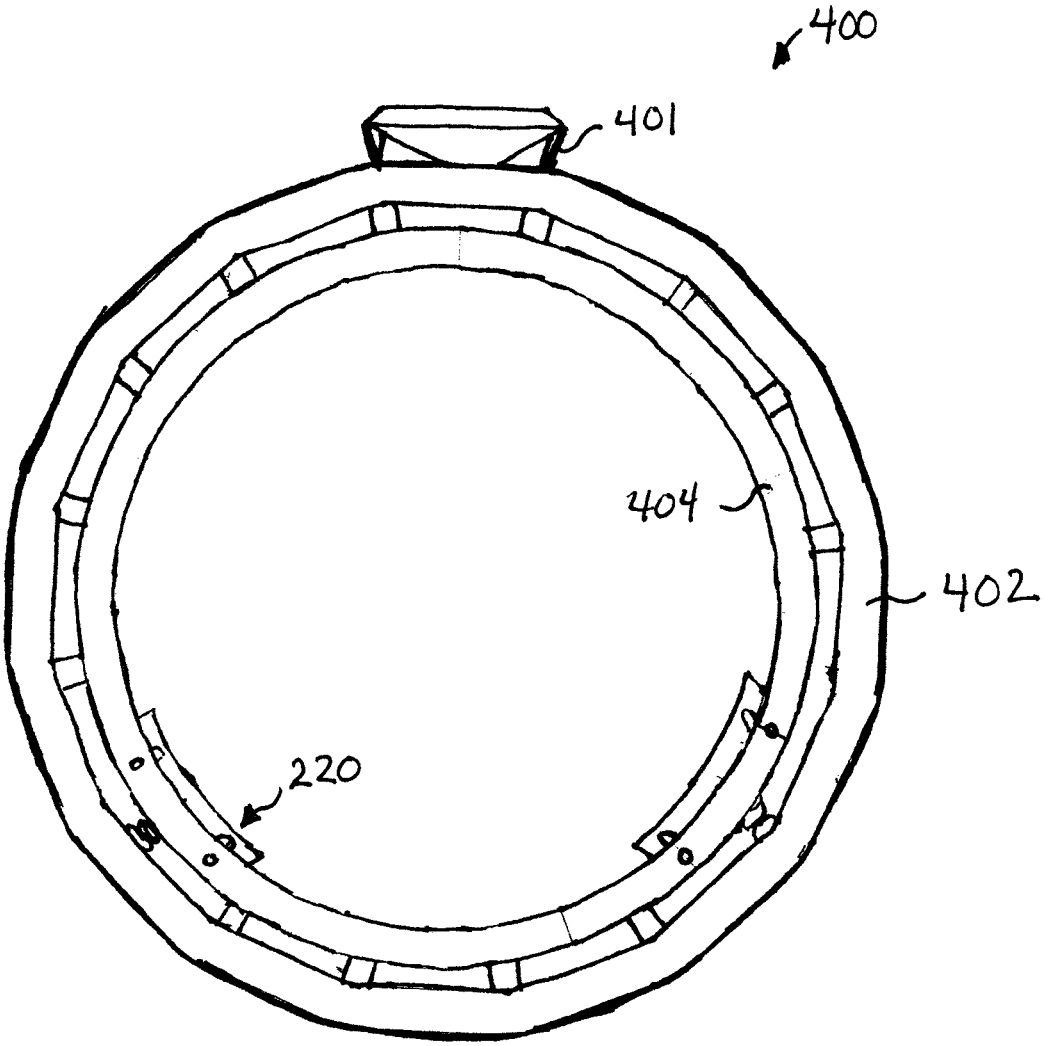
FIG. 16 is a side, plan view of a fourth embodiment of a jewelry ring having one of the size adjusting devices.

Turning now to FIG. 16, a fourth embodiment of a jewelry ring, generally designed by reference number 400, is illustrated that has a primary mount 401 as part of the outer ring 402 and a continuous radially facing outer surface defining the band of the ring. Here, the outer ring 402 only requires on opening defined therein that coincides with the primary mount 401. In this illustration, there are two arcuate inserts present, which are centered at a first position, which is 120 degrees clockwise from the primary mount 401, and a second position, which is 240 degrees clockwise from the primary mount 401. The other features of jewelry ring 400 are as discussed above for any of the embodiments of the size adjusting device, even though the size adjusting device is illustrated as being of the style 220 from FIG. 11. Moreover, the presence of two arcuate inserts positioned as described and shown in FIG. 16 is equally applicable to all embodiments disclosed herein.

One of skill in the art can mix and match the number and position of arcuate inserts of a selected arcuate length with any number of outer rings designs, such as a single primary mount as illustrated in FIG. 16 to an entire band of gems or gemstones as illustrated in FIGS. 1 and 10, or any combination thereof.

Although various aspects of the disclosed ring sizing system have been shown and described, modifications may become apparent to those skilled in the art upon reading the specification. The present application includes such modifications and is limited only by the scope of the claims.

What is claimed is:

1. A jewelry ring, comprising:

an outer ring fixedly spaced radially apart from an inner ring by a connecting member, the outer ring defining a plurality of open mountings to hold a gem or gemstone and the inner ring defining a first plurality of openings, one each aligned with one of the plurality of open mountings of the outer ring;

a gem or gemstone in each of the plurality of open mountings;

wherein at least two of the plurality of openings in the inner ring are interconnected by a slot, thereby collectively defining a receptacle; and a size adjusting device is seated in the receptacle and connected to the receptacle by a slot and pin mechanism enabling the size adjusting device to translates radially in and out between a smallest interior diameter position and a largest interior diameter position, the size adjusting device comprising:

an arcuate insert having a radially outer facing surface and a radially inner facing surface and comprising a plurality of segments each having a preselected exterior shape that matches and fits within one of the first plurality of openings in the inner ring; wherein each segment defines one of a second plurality of openings aligned one each with one of the plurality of open mountings of the outer ring such that, in the largest diameter position, each of the plurality of segments are in a surrounding relationship with a culet of the gem or gemstone; and a biasing member seated between the radially outer facing surface of the arcuate insert and the outer ring.

2. The jewelry ring of claim 1, wherein the biasing member is a coil spring or an elastomeric member.

3. The jewelry ring of claim 1, wherein, for the pin and slot mechanism, the pin extends from the inner ring and the slot is in the arcuate insert.

4. The jewelry ring of claim 1, wherein, for the pin and slot mechanism, the pin extends from the arcuate insert and the slot is in the inner ring.

5. The jewelry ring of claim 1, further comprising a plurality of arcuate inserts.

6. The jewelry ring of claim 1, wherein the preselected exterior shape of each of the plurality of segments is oval-shaped or circular-shaped rings.

7. The jewelry ring of claim 5, wherein each arcuate insert of the plurality of arcuate inserts is spaced equidistant apart from an immediately neighboring arcuate insert about the inner circumference of the inner ring.

8. The jewelry ring of claim 5, wherein the plurality of arcuate inserts comprises two arcuate inserts, one centered at a position 120 degrees clockwise from a primary mount and a second centered at a position 240 degrees clockwise from a primary mount.

9. The jewelry ring of claim 1, wherein the radially outward facing surface of the arcuate insert defines a receptacle for the biasing member.

10. The jewelry ring of claim 1, wherein the plurality of open mountings of the outer ring connect to touch one to another about the central axis to define the entire circumference of the outer ring.

11. A jewelry ring, comprising:

an outer ring fixedly spaced radially apart from an inner ring by a connecting member, the outer ring defining an open mounting to hold a gem or gemstone and the inner ring defining a first plurality of openings, wherein one of the first plurality of opening in the inner ring is aligned with the open mounting of the outer ring;

wherein at least two others of the plurality of openings in the inner ring are interconnected by a slot, thereby collectively defining a receptacle; and a size adjusting device is seated in the receptacle and connected to the receptacle by a slot and pin mechanism, wherein each slot of the slot and pin mechanism is elongate in the radial direction and each slot receives a pin therein, wherein the size adjusting device translates radially in and out between a smallest interior diameter position and a largest interior diameter position by linear translation in the radial direction of each pin relative to the slot it is received in or of each slot relative to the pin received therein, the size adjusting device comprising:

an arcuate insert comprising a plurality of segments each having a preselected exterior shape that matches and fits within one of the first plurality of openings in the inner ring; wherein each segment defines one of a second plurality of openings aligned one each with the at least two others of the plurality of openings and having a radially outer facing surface and a radially inner facing surface;

wherein immediately neighboring segments of the plurality of segments are linked together by a linking member, and each linking member includes a recess in the radially outer facing surface thereof; and a biasing member seated between the radially outer facing surface of the arcuate insert and the outer ring.

12. The jewelry ring of claim 11, wherein the biasing member is a coil spring or an elastomeric member.

13. The jewelry ring of claim 11, wherein, for the pin and slot mechanism, the pin extends from the inner ring and the slot is in the arcuate insert.

14. The jewelry ring of claim 11, wherein, for the pin and slot mechanism, the pin extends from the arcuate insert and the slot is in the inner ring.

15. The jewelry ring of claim 11, further comprising a plurality of arcuate inserts.

16. The jewelry ring of claim 11, wherein the preselected exterior shape of each of the plurality of segments is oval-shaped or circular-shaped rings.

17. The jewelry ring of claim 15, wherein each arcuate insert of the plurality of arcuate inserts is spaced equidistant apart from an immediately neighboring arcuate insert about the inner circumference of the inner ring.

18. The jewelry ring of claim 15, wherein the plurality of arcuate inserts comprises two arcuate inserts, one centered at a position 120 degrees clockwise from a primary mount and a second centered at a position 240 degrees clockwise from a primary mount.

19. The jewelry ring of claim 11, wherein the radially outward facing surface of the arcuate insert defines a receptacle for the biasing member.

20. The jewelry ring of claim 11, wherein the outer ring has a continuous radially outer surface about a portion of the circumference thereof.

21. The jewelry ring of claim 1, wherein each slot of the slot and pin mechanism is elongate in the radial direction and each slot receives a pin therein, wherein the size adjusting device-translates radially in and out between a smallest interior diameter position and a largest interior diameter position by linear translation in the radial direction of each pin relative to the slot it is received in or of each slot relative to the pin received therein.

22. The jewelry ring of claim 1, wherein immediately neighboring segments of the plurality of segments are linked together by a linking member, and each linking member includes a recess in the radially outer facing surface thereof in which a biasing member is seated.

* * * * *